United States Patent [19]

Adams

[11] 3,990,649

[45] Nov. 9, 1976

[54] ROUND NOSE TUBE

[75] Inventor: Hal M. Adams, Hartsville, S.C.

[73] Assignee: Sonoco Products Company, Hartsville, S.C.

[22] Filed: Oct. 3, 1974

[21] Appl. No.: 511,613

[52] U.S. Cl. ..... 242/118.32; 93/15

[51] Int. Cl.[2] ..... B65H 25/10

[58] Field of Search..... 242/118.32, 118.3, 118.31, 242/118.1, 118.11, 118.2, 46.2, 46.3; 93/15, 94 R, 8 D

[56] References Cited

UNITED STATES PATENTS

| | | | |
|---|---|---|---|
| 778,003 | 12/1904 | Berlizheimer | 242/118.32 |
| 2,597,960 | 5/1952 | Stearn | 242/118.32 |
| R23,046 | 10/1948 | Blanchet | 242/118.32 |

*Primary Examiner*—George F. Mautz

*Attorney, Agent, or Firm*—Dennison, Dennison, Meserole & Pollack

[57] ABSTRACT

A yarn carrier wherein at least one end of the tubular body member has a portion removed and the remaining thin end section is turned inwardly upon itself to provide a smooth, round nosed end on the tube and a straight, inside surface on the body wall.

4 Claims, 5 Drawing Figures

ROUND NOSE TUBE

It has been known for many years to provide cones, spinning bobbins and other textile carriers with rounded noses. However, these previously known constructions for yarn carriers have been provided by burnishing the end of the tube as with a chuck which would conform to the end configuration desired and which is rotated at various speeds to provide a smooth semi-rounded end.

An example of such a construction is that shown in the patents to Blanchet, U.S. Pat. No. 2,288,966 and Re. 23,046, wherein a core for a yarn package is shown which has one end of the core turned inwardly and subsequently sized to fit a tapered spindle. The spinning spindle was developed many years ago and the conventional tube was tapered to fit the tapered spinning spindle. Thus, tapered tubes or cones were used initially for the spindles. Substantially greater support and higher speeds of winding can be obtained by straight walled tubes and spindles. Therefore, the tapered spindle used with the Blanchet tube where the end of the tube is tapered to fit the spinning spindle does not perform as well as does a straight walled tube on a straight spindle.

These spinning bobbins, sometimes also referred to as draw winder or draw twister tubes, have counterparts generally referred to as yarn carriers which are used on different equipment for other products. Each of these constructions, both the cones or the tapered tubes and the straight walled yarn carrier, with or without the tapered end, utilized specific equipment that could maintain the winding speeds then prevalent. Certain modern day machinery requires the yarn carrier to be of greater strength and to be capable of multiple carriers being mounted on a single spindle to permit winding of several yarn packages at the same time. It is also necessary that these yarn carriers have smooth ends for proper yarn delivery when the yarn is removed from the carrier.

It has been known to round-nose the ends of tubes or yarn carriers, however, these tubes were incapable of fitting more than one tube to a spindle. Furthermore, in the past heavy walled yarn tubes have been round nosed, but in the process sharp crimps or cracks have been formed and the plies of paper comprising the tube wall have been separated because of the forces applied.

In order to overcome the problems and difficulties encountered in the prior art the instant invention contemplates utilization of a yarn carrier wherein a portion of the inside of the tubular body is removed and the thin remaining section is turned inwardly upon itself to provide the smooth yarn delivery surface at the end of the tube while permitting multiple carriers to be mounted on a single spindle.

The instant invention is shown in the accompanying drawings wherein like numerals refer to like or equivalent parts and wherein.

Figure 1:
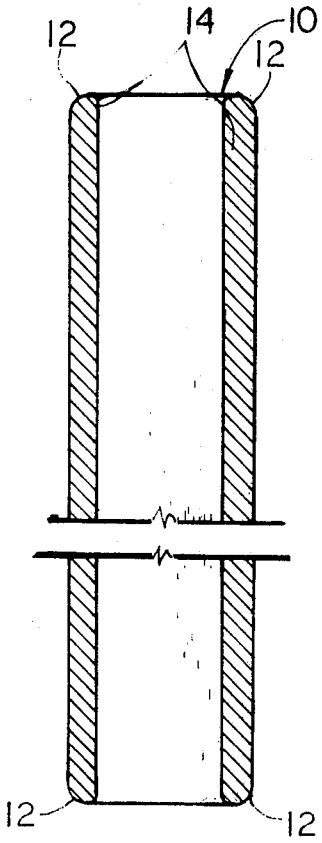
FIG. 1 is a cross sectional view of a Prior Art tube having burnished ends.

Referring now to the drawings wherein conventional yarn tube or carrier 10 is shown in FIG. 1 to have burnished end 12 and a straight inside surface. This tube is that currently being utilized on multiple carrier spindles, as well as single carrier spindles.

Figure 2:
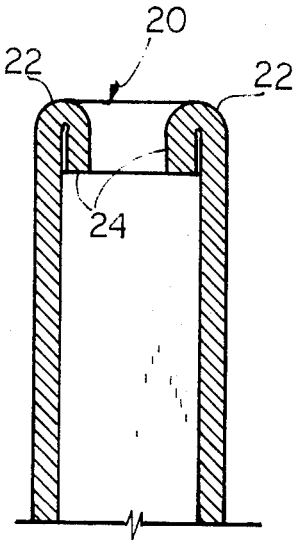
FIG. 2 is a cross sectional view of a conventional round nosed tube.

FIG. 2 shows conventional round nosed yarn tube 20 which by the nature of the crimp reduces the inside diameter at the nose such that only one tube may be mounted on a spindle. It is to be noted that, depending upon the wall thickness of tube 20, a multiplicity of crimps or cracks and rough edges are formed on the rounded nose 22 and the several plies tend to separate at end 24 because of the extreme pressures needed to round nose the tube.

Figure 3:
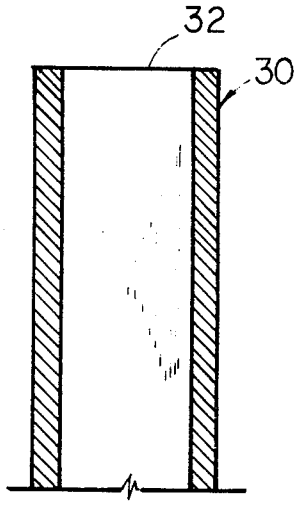
FIG. 3 is a cross sectional view of the end of a tube to be modified in accordance with the instant invention.
Figure 4:
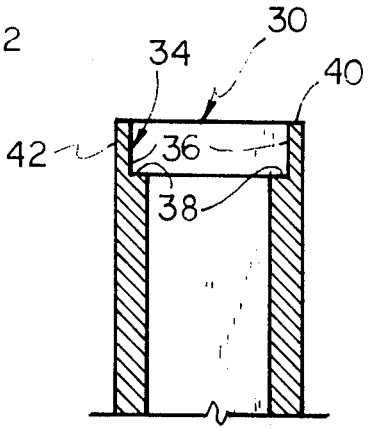
FIG. 4 is a cross sectional view of the tube of FIG. 3 with a portion of the inside removed in accordance with the invention.
Figure 5:
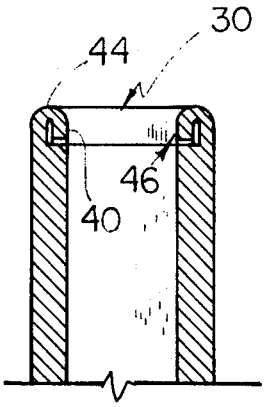
FIG. 5 shows the completed tube of the instant invention.

A conventional yarn carrying tube preform, such as shown in FIG. 3, may be either convolutely or spirally wound to provide a base tubular member or body 30 which is cut to the necessary length at end 32. The thus properly dimensioned tube preform is then passed to a station for removal of a portion of the inside of the tube at one end thereof. It is to be understood that the tubular member or body 30 may have one or both ends processed in accordance with the instant invention. Accordingly, only the treatment of one end is described herein.

At the station for removal of a portion of the inside to form rabbet 34 on the inside of the tube there is provided an inside surface 36 and end 38 of rabbet 34. The end 40 of thin end portion 42 is the cut end of the tube equivalent to 32. In most embodiments, rabbet 34 will have a thickness of approximately one-half that of the wall thickness of tube 30.

Once a portion of the tube has been removed as rabbet 34, the end of tubular member 30 is rounded as by axially forcing a rotating chuck having an inside configuration to cause thin end portion 42 to be folded upon itself against tube 30 on surface 36. End portion 42 is turned inwardly upon itself to form rounded portion 44 such that end 40 of thin end portion 42 may be forced inwardly sufficiently far to meet the overall length dimension of the carrier and no further than end 38 of removed portion 34. It is thus seen that the inside surface 46 of tube 30 is straight and tubular yarn carrier 30 has a smooth inside surface permitting several of the yarn carriers to be mounted on a single spindle while at the same time providing a smooth rounded end for proper yarn delivery once the yarn has been wound to form a package on carrier 30.

It is to be understood that, if the wall thickness of tubular member 30 is sufficiently great and it is not essential that the inside surface 46 be straight, it is possible to utilize the concept of removing a portion of the inside of the tube at one end for round nosing heavier walled tubes in order to avoid any crimping, cracking or breakdown of the adhesion of the plies at the end of the tube, thereby overcoming the previously encountered yarn delivery problems.

What is claimed is:

1. A method of forming a yarn carrier comprising the steps of: forming a cylindrical tubular preform from several plies of paper by spiral winding, removing a portion of the tubular wall on the inside of at least one end of said preform to provide a rabbet portion having a wall thickness of about one-half the wall thickness of the remainder of the preform, and inturning the rabbet wall by axially applying a rotating chuck to said end of the preform.

2. A cylindrical yarn carrier comprising:

a tubular spiral wound cylindrical member having a wall formed of a plurality of plies of paper adhered to one another, at least one end of said member having a portion on the inside wall thereof removed to leave an annular interior shoulder and a thin upstanding wall portion, said thin wall portion being folded inwardly upon itself to provide a smooth round nosed end on said carrier, said carrier having a constant inside diameter from end to end, whereby a plurality of said yarn carriers may be mounted on a single spindle.

3. A cylindrical yarn carrier as defined in claim 2 wherein the thin upstanding wall portion is of a thickness of approximately one-half the diameter of the total wall of said member.

4. The yarn carrier of claim 2 wherein both ends of said tubular member have a portion on the inside thereof removed leaving a thin end portion on each end of said tubular member; and each of said thin end portions turned inwardly upon itself.

* * * * *